US005415969A

United States Patent [19]

Waterman

[11] Patent Number: 5,415,969

[45] Date of Patent: May 16, 1995

[54] IMAGE-RECEIVING ELEMENT FOR DIFFUSION TRANSFER PHOTOGRAPHIC FILM PRODUCTS

[75] Inventor: Kenneth C. Waterman, Arlington, Mass.

[73] Assignee: Polaroid Corporation, Cambridge, Mass.

[21] Appl. No.: 132,534

[22] Filed: Oct. 6, 1993

[51] Int. Cl.[6] ..... G03C 1/805; G03C 8/24; G03C 8/52

[52] U.S. Cl. ..... 430/213; 430/212; 430/215; 430/259; 430/262; 430/263; 430/961

[58] Field of Search ..... 430/215, 961, 212, 213, 430/259, 263, 262

[56] References Cited

U.S. PATENT DOCUMENTS

| | | | |
|---|---|---|---|
| 3,591,379 | 7/1971 | Plakunov | 430/961 |
| 4,080,346 | 3/1978 | Bedell | 430/213 |
| 4,190,449 | 2/1980 | Naoi et al. | 430/961 |
| 4,298,682 | 11/1981 | Bishop | 430/533 |
| 4,346,160 | 8/1982 | Bishop | 430/215 |
| 4,429,032 | 1/1984 | Matthe et al. | 430/231 |
| 4,499,174 | 2/1985 | Bishop et al. | 430/215 |
| 4,668,602 | 5/1987 | Hosaka et al. | 430/207 |
| 4,769,306 | 9/1988 | Oberhauser et al. | 430/220 |

*Primary Examiner*—Richard L. Schilling
*Attorney, Agent, or Firm*—Gaetano D. Maccarone

[57] ABSTRACT

An image-receiving element for use in photographic diffusion transfer film units of the type Wherein the image-receiving element, which includes an image-receiving layer, is designed to be removed, or "peeled-apart", from a photosensitive element after exposure and development have been carried out. The image-receiving element includes an overcoat layer which overlies the image-receiving layer for reducing the time period for which the image-receiving element remains tacky after the element has been separated from the photosensitive element and for improving the handling and/or storage of the resulting photograph under high humidity conditions. The overcoat layer comprises colloidal silica particles and binder material.

16 Claims, 1 Drawing Sheet

IMAGE-RECEIVING ELEMENT FOR DIFFUSION TRANSFER PHOTOGRAPHIC FILM PRODUCTS

BACKGROUND OF THE INVENTION

This invention relates to an image-receiving element for use in photographic film units of the diffusion transfer type. More particularly, the invention relates to an image-receiving element especially adapted for use in diffusion transfer photographic film units of the type wherein an image-receiving element is designed to be separated from a photosensitive element after exposure and photographic processing have been effected.

Photographic film units of the diffusion transfer type, including those of the aforementioned "peel-apart" type, are well known in the art and have been described in numerous patents. Exemplary of these are U.S. Pat. Nos. 2,983,606; 3,345,163; 3,362,819; 3,594,164; and 3,594, 165. In general, diffusion transfer photographic products and processes involve film units having a photosensitive system including at least one silver halide layer, usually integrated with an image-providing material, e.g., an image dye-providing material. After photoexposure, the photosensitive system is developed, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the so-called "peel-apart" type, the image is viewed in the image-receiving layer upon separation of the image-receiving element from the photosensitive element after a suitable imbibition period. In other products, such separation is not required.

Image-receiving elements particularly adapted for use in "peel-apart" diffusion transfer film units have typically embodied an image-receiving layer for retaining the transferred image arranged on a substrate layer of suitable material or a combination of layers arranged on the substrate layer, each of the layers providing specific and desired functions adapted to the formation of the desired photographic image in accordance with diffusion transfer processing. Thus, in one well known embodiment the image-receiving element typically comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such preferred structure is described, for example, in the aforementioned U.S. Pat. No. 3,362,819 and is illustrated in other patents, including U.S. Pat. Nos. 4,322,489 and 4,547,451.

It is known that the surface of the image-receiving element remains wet and sticky, for some period of time after the element has been separated from the photosensitive element. During this time period care must be exercised in the handling of the photograph so as not to damage it. Further, in instances where it is desired to place the photograph in a holder of some type for storage purposes or where it is desired to laminate a protective layer over the photograph, it is necessary to wait until the surface of the photograph is sufficiently dry to permit it to be handled in that manner. The time period required to allow such handling varies dependent upon various factors such as the amount of water taken up by the image-receiving layer during photographic processing and the ambient relative humidity and temperature conditions. In addition, at any time after processing and drying, the photograph may encounter high relative humidity conditions which can render the surface of the photograph wet and sticky.

It would be very desirable to reduce the time period before the photograph can be further handled after photographic processing and separation of the image-receiving element from the photosensitive element. It would also be desirable for photographs to be handled and/or stored in high humidity conditions.

SUMMARY OF THE INVENTION

The present invention provides an image-receiving element which includes an overcoat layer overlying the image-receiving layer for significantly reducing the time period that the surface of the resulting photograph remains wet and sticky after photographic processing and separation of the image-receiving element from the photosensitive element. In addition, handling and/or storage of the photograph under high humidity conditions can be significantly improved. It has been found that the image-receiving element of the invention provides for the transfer of sufficient image dye-providing material to the image-receiving layer to provide the desired photographic quality and does not interfere with viewing of the photograph to any appreciable extent.

The overcoat layer which is incorporated in the image-receiving element of the invention comprises a major amount of colloidal silica particles, i.e., more than 50% by weight, and a minor amount of binder material present to prevent cracking of the layer during coating and drying and/or during photographic processing. The binder material may be soluble in the solvent from which the layer is coated, e.g., water, or coated from a dispersion of the material, e.g., a latex dispersion.

The overcoat layer, in addition to allowing sufficient dye-providing material to pass through to the image-receiving layer to provide a photograph of the desired quality, must not scatter visible light to any appreciable degree so as not to interfere with viewing of the photograph. This requirement can be accomplished in accordance with the invention by various techniques such as by utilizing colloidal silica particles and binder material whose indices of refraction are substantially matched and/or by utilizing colloidal silica particles having a particle size small enough so as not to scatter light intrinsically.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

Figure 1:
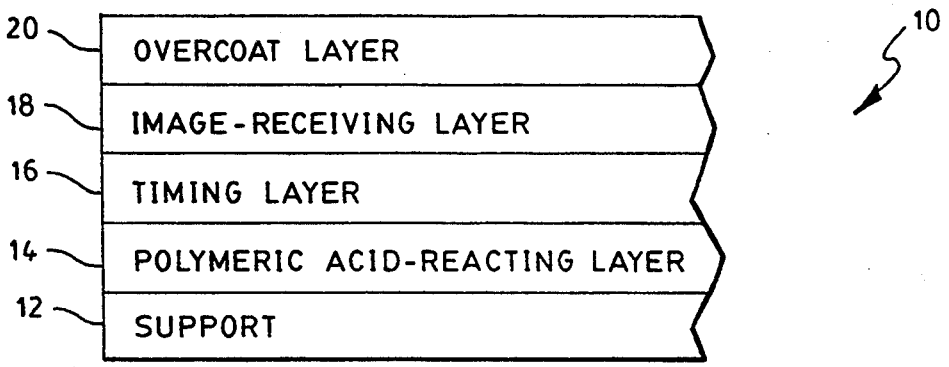
FIG. 1 is a partially schematic, cross-sectional view of one embodiment of an image-receiving element according to the invention.

Referring now to FIG. 1 there is seen an image-receiving element 10 according to the invention comprising a support layer 12 carrying a polymeric acid-reacting layer 14, a timing (or spacer) layer 16, an image-receiving layer 18 and an overcoat layer 20. Each of the layers carried by support layer 12 functions in a predetermined manner to provide desired diffusion transfer processing and is described in detail hereinafter.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulosic derivatives such as cellulose acetate or cellulose acetate-butyrate, can be suitably employed. Depending upon the desired nature of the finished photograph, the nature of support material 12 as a transparent, opaque or translucent material will be a matter of choice. Typically, an image-receiving element of the present invention, adapted to be used in so-called "peel-apart" diffusion transfer film units and designed to be separated after processing, will be based upon an opaque support material 12. As illustrated in the film unit of FIG. 2 (which shows the film unit after photographic processing and prior to the separation of image-receiving element 10*a* from the processed photosensitive element 30*b*), support 12 can comprise an opaque support material 12*a*, such as paper, carrying a light-reflecting layer 12*b*. On separation of the image-bearing photograph 10*a*, the image in layer 18*a* can be viewed against light-reflecting layer 12*b*. Light-reflecting layer 12*b* can comprise, for example, a polymeric matrix containing a suitable white pigment material, e.g., titanium dioxide.

While support material 12 of image-receiving element 10 will preferably be an opaque material for production of a photographic reflection print, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development. Upon processing and removal of the opaque pressure-sensitive sheet, the photographic image diffused into image-receiving layer 20 can be viewed as a transparency. In another embodiment where support material 12 is a transparent sheet, opacification materials such as carbon black and titanium dioxide can be incorporated in the processing composition to permit in-light development.

Figure 2:
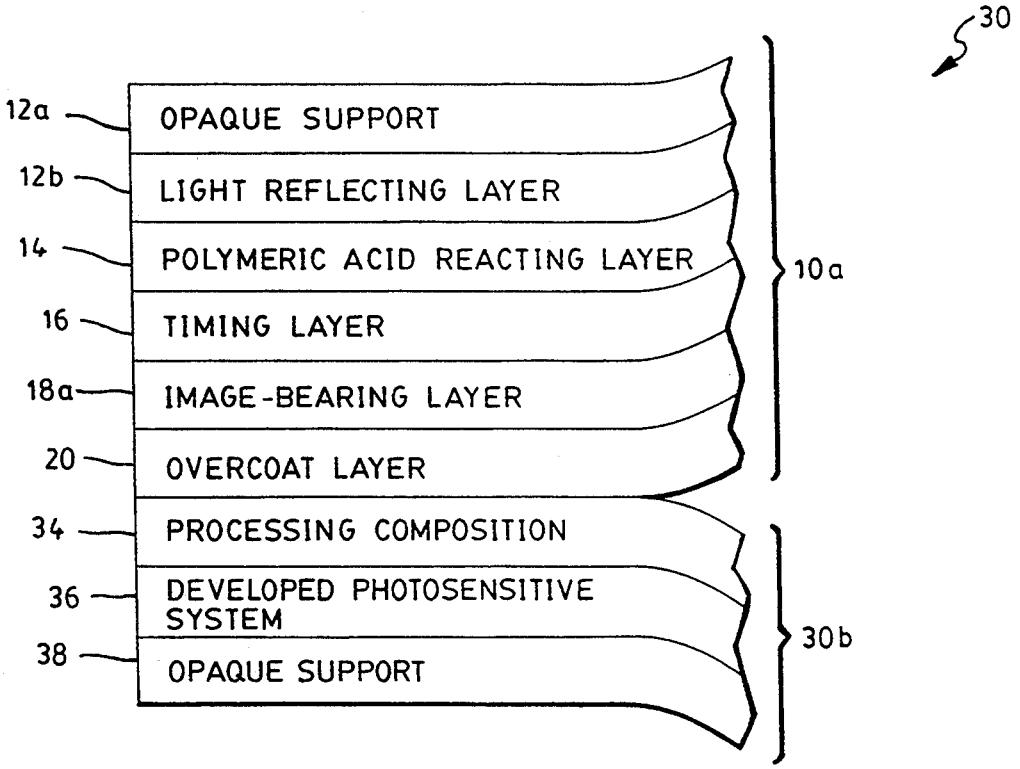
FIG. 2 is a partially schematic, cross-sectional view of a photographic film unit according to the invention, shown after exposure and processing.

In the embodiment illustrated, in FIGS. 1 and 2, image-receiving element 10 includes a polymeric acid-reacting layer 14. Polymeric acid-reacting layer 14 serves an important function in reducing the environmental pH of the film unit, subsequent to transfer image formation, to a pH at which the residual image dye-providing material remaining within the photosensitive structure is rendered non-diffusible. As disclosed, for example, in the previously referenced U.S. Pat. No. 3,362,81 9, the polymeric acid-reacting layer may comprise a nondiffusible acid-reacting reagent adapted to lower the pH from the first (high) pH of the processing composition in which the image dyes are diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer. Preferred polymers for neutralization layer 14 comprise such polymeric acids as cellulose acetate hydrogen phthalate; polyvinyl hydrogen phthalate; polyacrylic acid; polystyrene sulfonic acid; and maleic anhydride copolymers and half esters thereof.

Polymeric acid-reacting layer 14 can be applied, if desired, by coating support layer 12 with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of polymeric acid-reacting layer 14 comprises a mixture of a water soluble polymeric acid and a water soluble matrix, or binder, material. Suitable water-soluble polymeric acids include ethylene/maleic anhydride copolymers and poly(-methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the aforementioned U.S. Pat. Nos. 3,362,819 and 3,756,815, mention may be made of those disclosed in the following U.S. Pat. Nos. 3,765,885; 3,819,371; 3,833,367 and 3,754,910. A preferred polymeric acid-reacting layer 14 comprises a free acid of a copolymer of methyl vinyl ether and maleic anhydride and a vinyl acetate ethylene latex.

Timing layer 16 controls the initiation and the rate of capture of alkali by the acid-reacting polymer layer 14. As indicated previously, timing layer 16 serves as an alkali impermeable barrier for a predetermined time interval before converting in a rapid and quantitatively substantial fashion to a relatively alkali permeable condition, upon the occurrence of a predetermined chemical reaction. Timing layer 16 can be provided by resort to polymeric materials which are known in the diffusion transfer art and which are described, for example, in U.S. Pat. Nos. 4,201,587; 4,288,523; 4,297,431; 4,391,895; 4,426,481;4,458,001; 4,461,824 and 4,547,451. As described in these patents, timing layers having the aforedescribed characteristics can be prepared from polymers which comprise repeating units derived from polymerizable monomeric compounds containing groups which undergo a predetermined chemical reaction as a function of contact with alkali and which are then rendered permeable to alkali. Monomeric compounds which are capable of undergoing a beta-elimination or which undergo an hydrolytic degradation after a predetermined period of impermeability to alkali can be employed in the production of suitable polymeric timing layer materials.

Polymeric materials suitable for the production of timing layer 16 will typically be copolymers comprising repeating units of the aforedescribed type (i.e., repeating units derived from polymerizable monomers capable of undergoing an alkali-initiated chemical reaction after a predetermined "hold" time interval) and comonomeric units incorporated into the polymer to impart thereto predetermined properties. For example, the "hold time", i.e., the time interval during which timing layer 16 remains impermeable to alkali during processing, can be affected by the relative hydrophilicity of the layer resulting from incorporation of a given comonomer or mixture of comonomers into the timing layer polymer. In general, the more hydrophobic the polymer, the slower will be the rate of permeation of alkali into the timing layer to initiate the alkali-activated chemical reaction, i.e., the longer the alkali hold time. Alternatively, adjustment of the hydrophobic/hydrophilic balance of the polymer by inclusion of appropriate comonomeric units may be used to impart predetermined permeability characteristics to a timing layer as appropriate for a given usage within a film unit.

The predetermined hold time of timing layer 16 can be adjusted as appropriate for a given photographic process by means such as controlling the molar ratio or proportion of repeating units which undergo the desired alkali-initiated chemical reaction; altering the thickness of the timing layer; incorporation of appropriate comonomeric units into the polymeric to impart thereto a desired hydrophobic/hydrophilic balance or degree of coalescence; using different activating groups to affect the initiation and rate of the alkali-initiated chemical reaction; or utilizing other materials, particularly polymeric materials, in the timing layer to modulate the permeation of alkali into timing layer 16, thereby altering the time necessary for initiation of the desired and predetermined chemical reaction. This latter means of adjusting the hold time of timing layer 16 may include, for example, utilization of a matrix polymer material having a predetermined permeability to alkali or aqueous alkaline processing composition as determined, for example, by the hydrophobic/hydrophilic balance or degree of coalescence thereof.

In general, increased permeability to alkali or aqueous alkaline processing composition, and thus, a shorter hold time, may be obtained by increasing the hydrophilicity of the matrix polymer or decreasing the degree of coalescence. Alternatively, decreased permeability of alkali or aqueous alkaline processing composition into timing layer 16 and, thus, a longer hold time, may be obtained by increasing the hydrophobicity of the matrix polymer or increasing the degree of coalescence.

Examples of suitable comonomers which can be used in the production of copolymeric materials suited to application in timing layer 16 include acrylic acid; methacrylic acid; 2-acrylamido-2-methylpropane sulfonic acid; N-methyl acrylamide; methacrylamide; ethyl acrylate; butyl acrylate; methyl methacrylate; N-methyl methacrylamide; N-ethyl acrylamide; N-methylolacrylamide; N,N-dimethyl acrylamide; N,N-dimethyl methacrylamide; N-(n-propyl)acrylamide; N-isopropyl acrylamide; N-(β-hydroxy ethyl)acrylamide, N-(β-dimethylaminoethyl)acrylamide; N-(t-butyl)acrylamide; N-[β-(dimethylamino)ethyl]methacrylamide; 2-[2'-(acrylamido)ethoxy]ethanol; N-(3'-methoxy propyl)acrylamide; 2-acrylamido-3-methol butyramide; acrylamido acetamide; methacrylamido acetamide; 2-[2-methacrylamido-3'-methyl butyramido]acetamide; and diacetone acrylamide.

Matrix polymer systems adapted to utilization in timing layer 16 can be prepared by physical mixing of the matrix polymer and the polymer containing the repeating units capable of undergoing alkali-initiated chemical reaction, or by the preparation of the timing layer polymer in the presence of a preformed matrix polymer. Polymers which may be used as matrix polymers will generally be copolymers which comprise comonomer units such as acrylic acid; methacrylic acid; methyl methacrylate; 2-acrylamido-2-methylpropane sulfonic acid; acrylamide; methacrylamide; N,N-dimethyl acrylamide; ethyl acrylate; butyl acrylate; diacetone acrylamide; acrylamido acetamide; methacrylamido acetamide.

In the production of copolymeric timing layer materials, and in the production of matrix polymers, the comonomeric units, as well as the ratios thereof, should be chosen on the basis of the physical characteristics desired in the matrix polymer and in the timing layer in which it is to be utilized.

Reference has been made to the utilization (in timing layers containing polymers capable of undergoing alkali-initiated chemical reaction) of other materials, particularly polymeric materials, to adjust the hold time of the timing layer in a predetermined manner and as appropriate for a given photographic process. It will be understood, however, that the presence in timing layer 16 of polymer or other materials which adversely affect or negate the desired alkali impermeable barrier properties of timing layer 16 is to be avoided. In this connection, it should be noted that gelatin, and particularly unhardened gelatin, is readily swollen and permeated by aqueous alkaline compositions typically employed in photographic processing. Accordingly, the presence in a timing layer of the invention of amounts of gelatin or other materials which promote rapid permeation of the layer by alkali and which effectively negate the hold character of the layer are to be avoided. Timing layer 16 is typically applied as a water-impermeable layer which results from the coalescence and drying of a coating composition, e.g., a latex composition.

The image-receiving layer 18 generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061 to Howard C. Haas, A preferred image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346 issued to Stanley F. Bedell. Other materials can, however, be employed. Suitable mordant materials of the vinylbenzyltrialkylammonium type are described, for example, in U.S. Pat. No. 3,770,439, issued to Lloyd D. Taylor. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. A preferred hydrazinium mordant is poly(1-vinylbenzyl 1,1-dimethylhydrazinium chloride) which, for example, can be admixed with polyvinyl alcohol for provision of a suitable image-receiving layer.

Overcoat layer 20, which typically has a thickness of up to about 2 μm, and preferably between 1 and 1.5 μm, functions to allow sufficient image dye-providing material to be transferred to image-receiving layer 18 to provide a photograph of the desired quality and significantly reduces the amount of time during which the surface of the photograph remains sufficiently wet and sticky, such that the photograph cannot be touched or placed in a holder such as an envelope without damage thereto. Further, overcoat layer 20 should not scatter visible light to any appreciable degree since in the embodiment illustrated the photograph is viewed through overcoat layer 20.

As described previously, overcoat layer 20 comprises a major amount of colloidal silica particles and a minor amount of binder material. The silica particles are substantially insoluble in water and non-swellable when wet. The overcoat layer 20 can be coated from a coating fluid made up of a colloidal silica sol. In order to minimize any light scatter by layer 20, the colloidal silica particles typically have a small average particle size, for example, less than 300 nm and preferably less than 50 nm. It has also been found that blends of colloidal silica particles having different average particle sizes can help to prevent cracking in layer 20. Layer 20 may also include a surfactant material which will enhance the fluid stability of the coating fluid, function as a coating aid and/or provide surface lubrication to layer 20 after separation of the image-receiving and photosensitive elements to render the layer less sticky.

The binder material for overcoat layer 20 should be permeable to the photographic aqueous alkaline processing fluid and also to the image dye-providing material which transfers to the image-receiving layer 18 to provide the photograph. The binder material typically has a low molecular weight, for example, from about 10,000 to about 100,000 such that the viscosity of the material is low and does not act as a significant impediment to transfer of the image dye-providing material. The binder material is chosen to help prevent cracking in layer 20 during coating and drying of the layer and/or during photographic processing. The binder material may be soluble in the solvent from which layer 20 is coated, preferably water, or the layer may be coated from a dispersion of the binder material, e.g., a latex dispersion. Typical suitable water soluble binder materials include ethylene acrylic acid, polyvinyl alcohol and the like.

The binder material should not be sticky when wet with water. Blends of binder materials having different glass transition temperatures (Tg) can be used in overcoat layer 20. Materials having a relatively high Tg, i.e., above about 50° C., can be used to help prevent crack propagation. Typical suitable materials which have a relatively high Tg include Hostaflon TF 5032 (a polytetrafluoroethylene latex dispersion available from Hoechst Corp.) and Neocryl A-639 (a latex dispersion of an acrylate copolymer available from Zeneca Resins, Inc., Wilmington, Mass.). Materials which have a relatively low Tg, i.e., from about 0° C. to about 50° C. and preferably from about 0° C. to about 25° C., can be used to absorb stress because of their ability to spread and fill areas during dimensional changes which occur during drying of the element (after coating) and photographic processing, thereby reducing or eliminating cracking. Typical suitable materials which have a relatively low Tg include Joncryl 77 (a water dispersible styrene-acrylic polymer available from S. C. Johnson & Son, Racine, Wis.), Neocryl BT24 and Neocryl BT520 (latex dispersions of acrylate copolymers available from Zeneca Resins, Inc.). In a preferred embodiment, a blend of high Tg and low Tg materials is used as the binder for overcoat layer 20.

As noted previously, the overcoat layer 20 should not scatter visible light to any appreciable degree so as not to interfere with viewing of the photograph. In addition to the use of colloidal silica particles having a small average particle size as described above, light scatter can be further minimized by using binder material which has an index of refraction substantially the same as that of the colloidal silica particles. In the case of binder materials which have an index of refraction which is substantially different from that of the colloidal silica particles, or a relatively large average particle size, it is preferred to use only a relatively small amount of the material to minimize light scatter.

A particularly preferred overcoat layer 20 according to the invention comprises a 7.2:1:1.6 (parts by weight) ratio of: colloidal silica particles having an average particle size of about 14 nm; polytetrafluoroethylene particles having an average particle size of about 150 nm±100 nm; and an acrylate copolymer latex dispersion having a Tg of about 25° C.

Image-receiving element 10 according to the invention preferably also includes a strip-coat layer (not shown) coated over overcoat layer 20. The strip-coat layer can be used as a means of facilitating separation of image-receiving element 10 from a photosensitive element. Thus, in photographic film unit 30 which is processed by distribution of an aqueous alkaline processing composition between the image-receiving element and a photoexposed photosensitive element, the strip-coat layer would function to facilitate separation of the photograph 10*a* from the developed photosensitive element and processing composition layer (collectively 30*b*).

A strip-coat layer can be prepared from a variety of hydrophilic colloid materials. Preferred hydrophilic colloids for a strip-coat layer include gum arabic, carboxymethyl cellulose, hydroxyethyl cellulose, carboxymethyl hydroxyethyl cellulose, cellulose acetatehydrogen phthalate, polyvinyl alcohol, polyvinyl pyrrolidone, methyl cellulose, ethyl cellulose, cellulose nitrate, sodium alginate, pectin, polymethacrylic acid, polymerized salts or alkyl, aryl and alkyl sulfonic acids (e.g., Daxad, W. R. Grace Co.), polyoxyethylene polyoxypropylene block copolymers (e.g., Pluronic F-127, BASF Wyandotte Corp.) or the like.

The strip-coat layer can comprise a solution of hydrophilic colloid and ammonia as described in U.S. Pat. No. 4,009,031 and can be coated from an aqueous coating solution prepared by diluting concentrated ammonium hydroxide (about 28.7% $NH_3$) with water to the desired concentration, preferably from about 2% to about 8% by weight, and then adding to this solution an aqueous hydrophilic colloid solution having a total solids concentration in the range of about 1% to about 5% by weight. The coating solution also preferably may include a small amount of a surfactant, for example, less than about 0.10% by weight of Triton X-100 (Rohm and Haas, Co., Phil&, Pa.). A preferred solution comprises about 3 parts by weight of ammonium hydroxide and about 2 parts by weight of gum arabic.

A particularly preferred strip.-coat layer comprises a mixture of a hydrophilic colloid such as gum arabic and an aluminum salt such as aluminum lactate. An image-receiving element which includes a strip-coat layer comprising a hydrophilic colloid and an aluminum salt is disclosed and claimed in commonly-assigned application, Ser. No. 08/325,538 of James A. Foley, Nicholas S. Hadzekyriakides and James J. Reardon, filed concurrently herewith.

The image-receiving elements of the present invention are especially adapted to utilization in film units intended to provide multicolor dye images. The image-receiving elements can be processed with a photosensitive element and a processing composition as illustrated in FIG. 2. The most commonly employed negative components for forming multicolor images are of the "tripack" structure and contain blue-, green-, and red-sensitive silver halide layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,740,448 to P. O. Kliem.

Although the image-receiving layer of the invention has been described in detail with respect to the preferred embodiment illustrated in FIG. 1, it should be noted that the overcoat layer according to the invention may be used in conjunction with any image-receiving element used in diffusion transfer photographic film units. The diffusion transfer photographic film unit described in Japanese patent application 561-52685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. An overcoat layer according to the present invention can be arranged between the image-receiving layer and the peelable layer of this type of diffusion transfer film unit to reduce the period of time that the image-receiving element remains wet, or tacky, after separation.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

An image-receiving element was prepared comprising the following layers coated in succession on a white-pigmented polyethylene coated opaque support:

1. a polymeric acid-reacting layer, at a coverage of about 2390 mgs/ft$^2$ (about 25726 mgs/m$^2$), comprising 9 parts Gantrez S-97 (from GAF Corp.), a free acid of a copolymer of methyl vinyl ether and maleic anhydride and 11 parts Airflex 465 (Air Products Co.) vinyl acetate ethylene latex;
2. a timing layer coated at a coverage of about 250 mgs/ft$^2$ (about 2691 mgs/m$^2$) comprising a copolymer of diacetone acrylamide and acrylamide grafted onto polyvinyl alcohol;
3. a hold-release timing layer coated at a coverage of about 235 mgs/ft$^2$ (about 2529 mgs/m$^2$) comprising a copolymer of diacetone acrylamide/butyl acrylate/carboxymethoxymethyl acrylate/methacrylic acid;
4. an image-receiving layer coated at a coverage of about 300 mgs/ft$^2$ (about 3229 mgs/m$^2$) of a graft copolymer comprising 4-vinyl pyridine (4 VP) and vinyl benzyl trimethylammonium chloride (TMQ) grafted onto hydroxyethylcellulose (HEC);
5. a strip coat layer coated at a coverage of about 86 mgs/ft$^2$ (about 926 mgs/m$^2$) of gum arabic.

This image-receiving element was used as a means of establishing a comparative evaluation with image-receiving elements according to the invention and is identified herein as CONTROL.

EXAMPLE II

Image-receiving elements (A–E) according to the invention were prepared. These were the same as the CONTROL with the exception that each included an overcoat layer between the image-receiving layer and the strip-coat layer as follows:

Image-receiving element A—an overcoat layer comprising a 7.2:1:1.6 mixture of: colloidal silica having a particle size of about 14 nm (Nyacol 1040 LS); polytetrafluoroethylene latex dispersion (Hostaflon TF 5032) and an acrylate copolymer latex dispersion (Neocryl BT520) having a Tg of about 25° C.

Image-receiving element B—included an overcoat layer comprising a 7.2:1:1.6 mixture of colloidal silica having an average particle size of about 14 nm; polytetrafluoroethylene latex dispersion and an acrylate copolymer latex dispersion (Neocryl BT24) having a Tg of about Image-receiving element C—included an overcoat layer comprising a 7.2:1:1.6 mixture of colloidal silica having an average particle size of 14 nm; polytetrafluoroethylene latex dispersion and a styreneacrylic acid copolymer latex dispersion (Joncryl 77 from S. C. Johnson & Son).

Image-receiving element D—included an overcoat layer comprising a 7.2:1:1.6 mixture of colloidal silica having an average particle size of 14 nm, polytetrafluoroethylene latex dispersion and ethylene acrylic acid;

Image-receiving element E included an overcoat layer comprising a 60/40 mixture of colloidal silica particles (a 9:1 ratio of average particle size of 14:100 nm) and an acrylate copolymer latex dispersion (Neocryl BT24).

EXAMPLE III

The image-receiving elements of Examples I and II were evaluated in photographic film units of the "peel-apart" type in the following manner:

A photosensitive element was utilized for the processing and evaluation of each of the image-receiving elements. The photosensitive element comprised an opaque subcoated polyethylene terephthalate photographic film base having the following layers coated thereon in succession:

1. a layer of sodium cellulose sulfate coated at a coverage of about 25 mgs/m$^2$;
2. a cyan dye developer layer comprising about 960 mgs/m$^2$ of the cyan dye developer represented by the formula

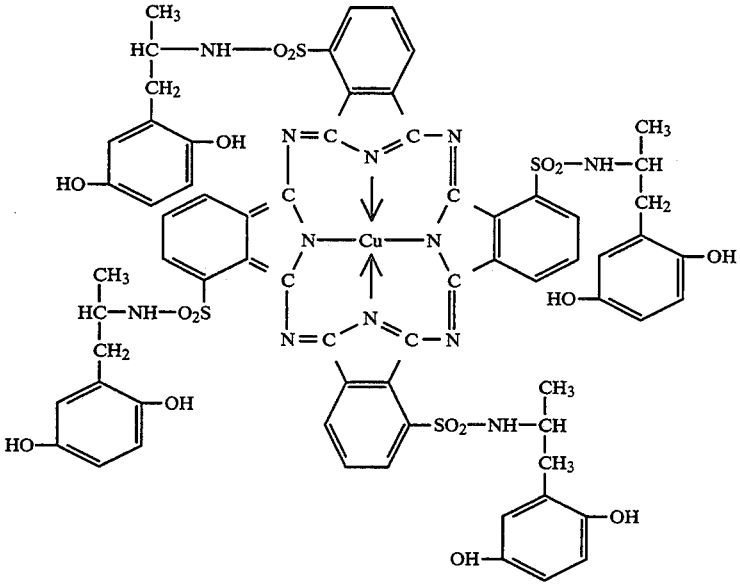

about 540 mgs/m$^2$ of gelatin and about 245 mgs/m$^2$ of phenyl norbornenyl hydroquinone (PNEHQ);

3. a red-sensitive silver iodobromide layer comprising about 780 mgs/m$^2$ of silver (0.6 micron), about 420 mgs/m$^2$ of silver (1.5 microns) and about 660 mgs/m$^2$ of gelatin;
4. an interlayer comprising about 2325 mgs/m$^2$ of a copolymer of butyl acrylate/diacetone acrylamide/methacrylic acid/styrene/acrylic acid, about 97 mgs/m$^2$ of polyacrylamide, about 124 mgs/m$^2$ of dantoin and about 3 mgs/m$^2$ of succindialdehyde;

b 5. a magenta dye developer layer comprising about 455 mgs/m$^2$ of a magenta dye developer represented by the formula

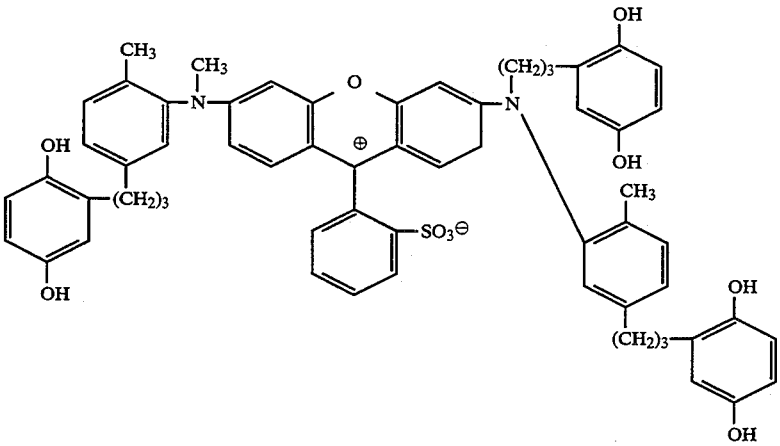

about 240 mgs/m$^2$ of gelatin and about 234 mgs/m$^2$ of 2-phenyl benzimidazole;

6. a spacer layer comprising about 250 mgs/m$^2$ of carboxylated styrenebutadiene latex (Dow 620 latex) and about 83 mgs/m$^2$ of gelatin;
7. a green-sensitive silver iodobromide layer comprising about 540 mgs/m$^2$ of silver (0.6 micron), about 360 mgs/m$^2$ of silver (1.3 microns) and about 396 mgs/m$^2$ of gelatin;
8. a layer comprising about 263 mgs/m$^2$ of PNEHQ and about 116 mgs/m$^2$ of gelatin;
9. an interlayer comprising about 1448 mgs/m$^2$ of the copolymer described in layer 4 and about 76 mgs/m$^2$ of polyacrylamide and about 4 mgs/m$^2$ of succindialdehyde;
10. a layer comprising about 1000 mgs/m$^2$ of a scavenger, 1-octadecyl-4,4-dimethyl-2-[2-hydroxy-5-(N-(7-caprolactamido)sulfonamido]thiazolidine and about 416 mgs/m$^2$ of gelatin;
11. a yellow filter layer comprising about 241 mgs/m$^2$ of benzidine yellow dye and about 120 mgs/m$^2$ of gelatin;
12. a yellow image dye-providing layer comprising about 257 mgs/m$^2$ of a yellow image dye-providing material represented by the formula

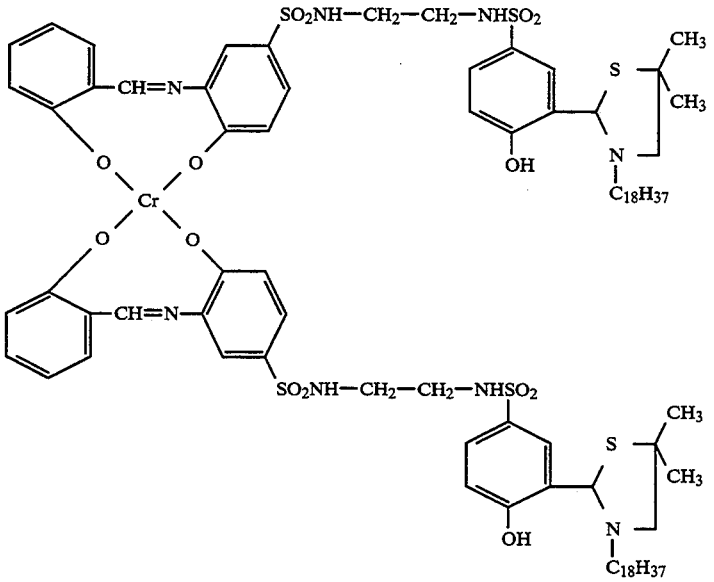

and about 503 mgs/m$^2$ of gelatin;

13. a blue-sensitive silver iodobromide layer comprising about 37 mgs/m$^2$ of silver (1.3 microns), about 208 mgs/m$^2$ of silver (1.6 microns), and about 108 mgs/m$^2$ of gelatin;
14. about 450 mgs/m$^2$ of phenyl tertiarybutyl hydroquinone, about 150 mgs/m$^2$ of 5-t-butyl-2,3-bis[(1-phenyl-1H-tetrazol-5-yl)thio ]-1,4-benzenediol bis[(2-methanesulfonylethyl)carbamate]; and about 250 mgs/m$^2$ of gelatin;
15. a layer comprising about 500 mgs/m$^2$ of an ultraviolet filter, Tinuvin (Ciba-Geigy), about 190 mgs/m$^2$ of benzidine yellow dye and about 345 mgs/m$^2$ of gelatin; and
16. a layer comprising about 300 mgs/m$^2$ of gelatin, Film units were prepared utilizing each of the receiving elements of Examples I and II and the above-described photosensitive element. In each case, after photoexposure of the photosensitive element, the image-receiving element and the photosensitive element were arranged in face-to-face relationship, i.e., with their respective supports outermost, and a rupturable container containing an aqueous alkaline processing composition was affixed between the image-receiving and photosensitive elements at the leading edge of each film unit such that the application of compressive pressure to tile container would rupture the seal of the container along its marginal edge and distribute the contents uniformly between the respective elements. The composition of the aqueous alkaline processing composition utilized for the processing of each film unit is set forth in Table I.

TABLE I

| Processing Composition | |
|---|---|
| Component | Parts by Weight |
| Potassium hydroxide | 5.1 |
| 1-(4-hydroxyphenyl)-1H-tetrazole-5-thiol | 0.004 |
| N-butyl-α-picolinium bromide | 1.8 |
| 1-methylimidazole | 0.25 |
| 1,2,4-triazole | 0.606 |
| hypoxanthine | 1.03 |
| 3,5-dimethylpyrrazole | 0.418 |
| sodium hydroxide | 1.28 |
| 2-(methylamino)ethanol | 0.25 |

TABLE I-continued

| Processing Composition | |
|---|---|
| Component | Parts by Weight |
| Guanine | 0.125 |
| Aluminum hydroxide hydrate | 0.24 |
| 5-amino-1-pentanol | 0.5 |
| Hydroxyethylcellulose | 2.86 |
| Chlorobenzenesulfinate | 1.0 |
| Titanium dioxide | 0.17 |
| Water | Balance to 100 |

Each film unit was subjected to exposure to a standard photographic sensitometric target and was processed at room temperature (about 20° C.) by spreading the processing composition between the image-receiving and photosensitive elements as they were brought into superposed relationship between a pair of pressure rollers having a gap of about 0.0036". After an imbibition period of about 90 seconds, the image-receiving element in each case was separated from the remainder of the film unit to reveal the image.

The Dmin area of the photograph obtained from each image-receiving element was evaluated with a tissue test to determine the time period necessary to allow the surface to be handled. In this test a tissue paper was placed in contact with pressure with the surface of the photograph after differing time intervals following the separation of the image-receiving element from the photosensitive element. The tissue was allowed to stay in contact with the photograph for about 3–5 seconds and then pulled away. The tissue tackiness time reported is the number of minutes (following separation of the elements) before no fiber is transferred from the tissue to the surface of the photograph, thus indicating when the photograph could be further handled such as by placing it in an envelope for storage.

In addition, Dmin photographs obtained with the CONTROL and image-receiving elements A-E were placed in envelopes, with pressure, for a period of at least one hour after differing time intervals following separation of the respective elements. The envelope tackiness time reported is the number of minutes (following separation of the elements) before no fiber is transferred from the envelope to the surface of the photograph.

The results are shown in Table II. It can be seen that the image-receiving elements according to the invention exhibit a significantly reduced time period after which they can be further handled. It can also be seen, from the red, green and blue Dmax values, that the image-receiving elements according to the invention also allowed sufficient image-dye providing materials to diffuse to the image-receiving layer to provide an acceptable photograph.

TABLE II

| Photograph from Image-Receiving Element | Tissue Tackiness Time (min) | Envelope Tackiness Time (min) | Dmax R | Dmax G | Dmax B |
|---|---|---|---|---|---|
| CONTROL | 15 | 6 | 2.00 | 2.21 | 1.77 |
| A | 6 | 0.5 | 1.73 | 1.97 | 1.64 |
| B | 6 | 0.5 | 1.75 | 1.97 | 1.65 |
| C | 6 | 0.5 | 1.67 | 1.97 | 1.64 |
| D | 6 | 0.5 | 1.67 | 1.97 | 1.64 |
| E | 5 | 0.5 | 1.92 | 2.04 | 1.64 |

In addition, photographs obtained with a CONTROL image-receiving element and elements A and B according to the invention were subjected to a rehumidification test wherein initially the photographs were initially allowed to dry at ambient conditions overnight. Each photograph was then placed in an envelope with sufficient pressure to keep the photograph in contact with the paper and maintained in this condition for 24 hours at 90% relative humidity. After this time period, each photograph was removed from the envelope and inspected visually for the presence of fibers adhering to the surface of the photograph.

The CONTROL photograph had a significant amount of paper fibers adhering to its surface, whereas photographs A and B, respectively, did not have any, thus indicating that the surface of the photographs according to the invention did not become wet and sticky upon rehydration.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. An image-receiving element for use in a photographic diffusion transfer color process which comprises, in sequence:

a support;

an image-receiving layer; and an overcoat layer residing on said image-receiving layer, said overcoat layer comprising a major amount of colloidal silica particles and a minor amount of water-insoluble polymeric latex binder material.

2. The image-receiving element as defined in claim 1 wherein said overcoat layer has a thickness of up to about 2 μm.

3. The image-receiving element as defined in claim 1 wherein said binder material comprises a blend of particles having a glass transition temperature above about 50° C. and particles having a glass transition temperature of from about 0° C. to about 25° C.

4. The image-receiving element as defined in claim 3 wherein said particles having a glass transition temperature above about 50° C. are polytetrafluoroethylene particles.

5. The image-receiving element as defined in claim 3 wherein said colloidal silica particles and said particles having a glass transition temperature of from about 0° C. to about 25° C. have substantially the same index of refraction.

6. The image-receiving element as defined in claim 1 and further including a strip-coat layer residing on said overcoat layer, said strip-coat layer comprising a hydrophilic colloid.

7. The image-receiving element as defined in claim 1 wherein said image-receiving layer comprises a graft copolymer of 4-vinylpyridine and vinyl benzyl trimethylammonium chloride grafted onto hydroxyethylcellulose.

8. The image-receiving element as defined in claim 1 wherein said colloidal silica particles have an average particle size of about 300 nm or less.

9. A photographic product for forming a diffusion transfer dye image which comprises, in combination:

a photosensitive element comprising a support which carries at least one silver halide emulsion layer associated with an image dye-providing material;

an image-receiving element comprising a support carrying an image-receiving layer and an overcoat layer residing on said image-receiving layer, said overcoat layer comprising a major amount of colloidal silica particles and a minor amount of water-insoluble polymeric latex binder material; and means providing an aqueous alkaline processing composition for initiating development of said silver halide emulsion after photoexposure to form a dye image on said image-receiving layer.

10. The photographic product as defined in claim 9 wherein said overcoat layer has a thickness of up to about 2 μm.

11. The photographic product as defined in claim 9 wherein said binder material comprises a blend of particles having a glass transition temperature above about 50° C. and particles having a glass transition temperature of from about 0° C. to about 25° C.

12. The photographic product as defined in claim 11 wherein said particles having a glass transition temperature above about 50° C. are polytetrafluoroethylene particles.

13. The photographic product as defined in claim 11 wherein said colloidal silica particles and said particles having a glass transition temperature of from about 0° C. to about 25° C. have substantially the same index of refraction.

14. The photographic product as defined in claim 9 wherein said colloidal silica particles have an average particle size of about 300 nm or less.

15. The photographic product as defined in claim 9 and further including a strip-coat layer residing on said overcoat layer, said strip-coat layer comprising a hydrophilic colloid.

16. The photographic product as defined in claim 9 wherein said image-receiving layer comprises a graft copolymer of 4-vinylpyridine and vinyl benzyl trimethylammonium chloride grafted onto hydroxyethylcellulose.

* * * * *